US005382188A

United States Patent [19]

Tomellini

[11] Patent Number: 5,382,188

[45] Date of Patent: Jan. 17, 1995

[54] AUDIO PLAYBACK DEVICE

[75] Inventor: Dalita R. Tomellini, Rehoboth, Mass.

[73] Assignee: Playskool, Inc., Pawtucket, R.I.

[21] Appl. No.: 79,745

[22] Filed: Jun. 21, 1993

[51] Int. Cl.[6] ..... A63H 5/00; A63H 33/30

[52] U.S. Cl. ..... 446/397; 446/142; 446/484; 434/309

[58] Field of Search ..... 446/142, 397, 484, 297; 434/402, 308, 309, 319, 169, 185, 335, 365; 273/454, 455; 340/384 E

[56] References Cited

U.S. PATENT DOCUMENTS

| | | | |
|---|---|---|---|
| 3,529,832 | 9/1970 | Goetz et al. . | |
| 3,554,556 | 1/1971 | Stewart . | |
| 3,711,964 | 1/1973 | Folson et al. | 434/318 |
| 4,150,831 | 4/1979 | Watanabe | 369/31 |
| 4,433,404 | 2/1984 | Watanabe | 369/66 |
| 4,713,035 | 12/1987 | Thom | 446/141 |
| 5,054,012 | 10/1991 | Koike et al. | 369/31 |

*Primary Examiner*—Mickey Yu
*Attorney, Agent, or Firm*—Kurt R. Benson

[57] ABSTRACT

An audio playback device is formed in the configuration of a conventional telephone. The device includes an image plate having a plurality of images thereon, and an integrated circuit assembly having a memory which is pre-programmed with a plurality of sound tracks which correspond to the images on the image plate. The circuit assembly further includes an output unit for outputting selected sound tracks, and a switch assembly for actuating the output unit for outputting selected sound tracks. The device is further provided with a rotatable selector for individually selecting the images and for operating the switch assembly.

9 Claims, 4 Drawing Sheets

AUDIO PLAYBACK DEVICE

BACKGROUND OF THE INVENTION

The instant invention relates to the toy art and more particularly to an audio playback device for use by children.

Audio playback devices have heretofore been known in the art to have significant play value. In this regard, the U.S. Pat. Nos. to Goetz et al 3,529,832; Stewart 3,554,556; Folsen et al 3,711,964; Watanabe 4,150,831; Watanabe 4,433,404; Thom 4,713,035; and Koike 5,054,012 illustrate exemplary devices of this general type and represent the closest prior art to the subject invention of which the applicant is aware.

Specifically, the patent to Goetz et al discloses a sound illustrated book comprising a plurality of graphically illustrated pages, a rotatable indicator dial which is mounted in an aperture extending through the pages and a sound reproducing means which is pre-programmed with a plurality of recorded messages. Each message corresponds to the printed matter on a corresponding page and each page has radially disposed indicia thereon adjacent the aperture. The Goetz et al device is operative by opening the book to a page and turning the indicator dial so that it points to the radial indicia for selecting a message corresponding to the page.

The patent to Stewart concerns a teaching device comprising a housing containing a phonograph record having a plurality of sound tracks which are selectively playable in response to a rotatable and depressible dial. The dial co-acts with a locking mechanism, and the housing includes means for receiving a plurality of interlocking puzzle pieces. When the puzzle pieces are assembled on the housing, they selectively disengage the locking mechanism allowing depression of the dial whereby the sound track corresponding to the selected puzzle piece is reproduced.

The Folson patent is directed to a phonograph toy having a pointer that can be manually turned to select one of several pictures to cause the toy to reproduce sounds that correspond to the selected picture. The sounds are reproduced from a record which comprises a disk having a plurality of spaced lead-in grooves thereon. The particular groove that is played when the toy is actuated is determined by the rotational position of the disc after the toy has been wound prior to playing.

The patent to Watanabe U.S. Pat. No. 4,150,831 discloses a toy record player having an upwardly biased, vertically movable shaft. The upper end of the shaft defines a push-button for starting the device and it also functions as a record holder for holding and rotating a record disk. The record disk has a plurality of prerecorded grooves on the lower surface thereof and a plurality of markings on the upper surface thereof which mark the starting positions of the prerecorded grooves. Depression of the push-button closes a circuit for rotating the record disk and lowers the disk into engagement with a record stylus.

The second patent to Watanabe U.S. Pat. No. 4,433,404 discloses a sound reproducing device having a rotatable shaft, a turntable fixedly attached to the shaft, a record disk mounted on the turntable, a torque spring motor, and a one way clutch disposed between the motor and the turntable.

The patent to Thom concerns a toy telephone having a dial and a sound generating means which is activated by the dial. The dial is mounted for both rotary and axial movement wherein the sound generating means is operative for generating a first sound upon rotary movement of the dial and a second sound upon axial movement thereof.

The patent to Koike discloses another sound reproducing device having a grooved record disk. The device comprises a casing, a record disk unit which is mounted on a rotatable pin in the casing, means for rotating the record disk, an index setting knob, and an index setting ring.

SUMMARY OF THE INVENTION

The instant invention provides an audio playback device which resembles a telephone.

Briefly, the audio playback device comprises a housing which resembles a conventional telephone housing, an integrated circuit assembly having a memory which is pre-programmed with a plurality of pre-recorded sound tracks, an output unit for outputting selected sound tracks and a switch assembly for actuating the output unit for outputting selected sound tracks. The housing includes a face plate having a plurality of fanciful cartoon images thereon, each of which corresponds to one of the pre-recorded sound tracks, and the cartoon images are arranged in a circular array. A rotatable dial or selector is provided in the center of the face plate for individually selecting the images and for operating the switch assembly to actuate the output unit to reproduce the sound tracks corresponding to the selected images. The selector includes a resilient finger plate which is positioned between the switch assembly and the face plate, and the finger plate includes a plurality of radially extending finger portions which are in radial alignment with predetermined areas of the switch assembly. The finger portions are selectively depressible for operating the switch assembly to actuate the output unit to reproduce the sound track which corresponds to a selected image. More specifically, a radial finger element on the selector pushes downwardly on the corresponding finger portion on the finger plate, causing the finger portion to operate the switch assembly to actuate the output unit to produce the corresponding sound tracks. The selector is provided with a cam mechanism which causes it to automatically rotate to a position of proper alignment with the appropriate finger portion when the selector is depressed.

Accordingly, it is an object of the instant invention to provide an audio playback device which resembles a telephone.

It is another object to provide an audio playback device having a memory which is programmed with plurality of pre-recorded sound tracks, an output unit for outputting the pre-recorded sound tracks, and a switch assembly for selectively actuating the output unit to output the sound tracks.

It is still another object to provide an audio playback device having a selector which is rotatable for selecting an image corresponding to a pre-recorded sound track and which is depressible for selectively actuating a switch assembly for outputting the selected message.

It is yet another object to provide an audio playback device having a rotatable selector and a resilient finger plate having a plurality of finger elements which are selectively depressible for selectively actuating a switch assembly.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
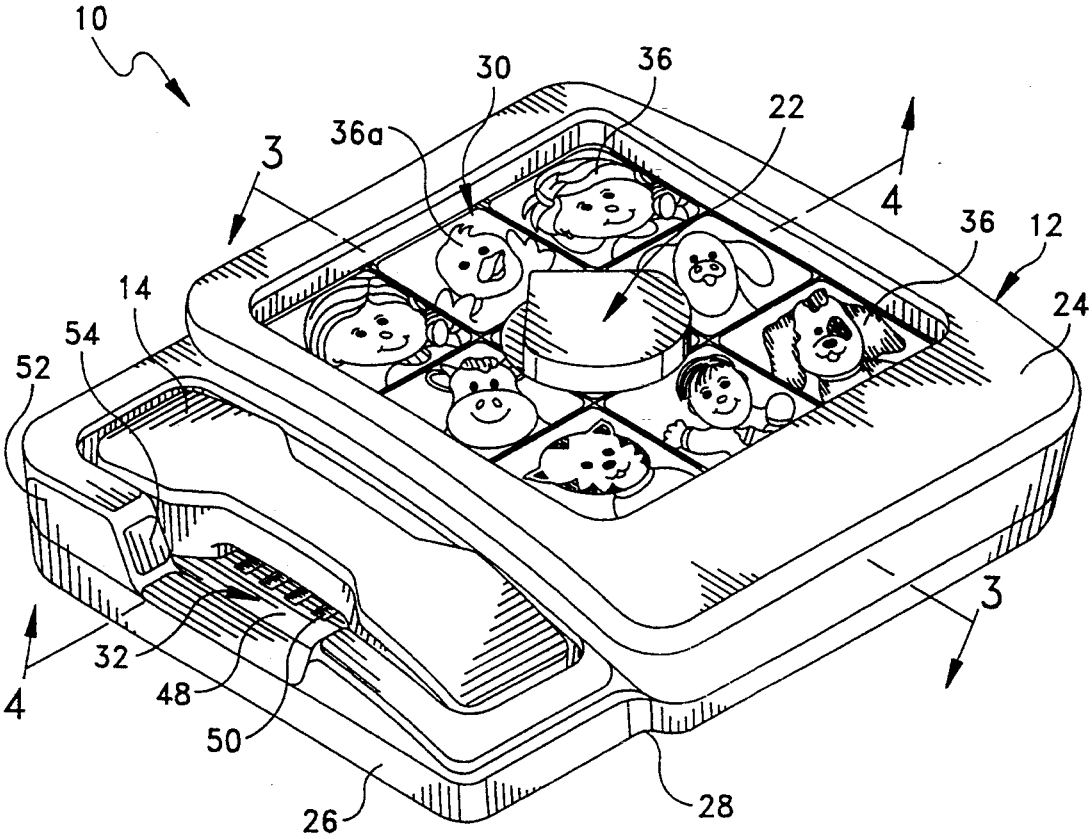
FIG. 1 is a perspective view of the audio playback device of the instant invention.

Referring now to the drawings, the audio playback device of the instant invention is illustrated and indicated at 10 in FIG. 1. As will hereinafter be more fully described, the playback device 10 is formed in the shape of a telephone, and it operative for playing back a plurality of pre-recorded sound tracks which correspond to a plurality of cartoon images on the body portion of the telephone. The audio playback device 10 comprises a housing generally indicated at 12, a removable handset element 14, an integrated circuit assembly generally indicated at 16, a mounting plate 17 for the circuit assembly, a speaker element 18, a resilient finger plate generally indicated at 20, and a selector mechanism generally indicated at 22.

The housing 12 comprises upper and lower body section halves 24 and 26 respectively, which are received and secured in interfitting engagement so that they cooperate to define a housing for the integrated circuit assembly 16, the mounting plate 17, the speaker element 18 and the finger plate 20. More specifically, the upper and lower body sections 24 and 26, are formed so that the housing 12 generally resembles the base portion of a conventional telephone.

Figure 3:
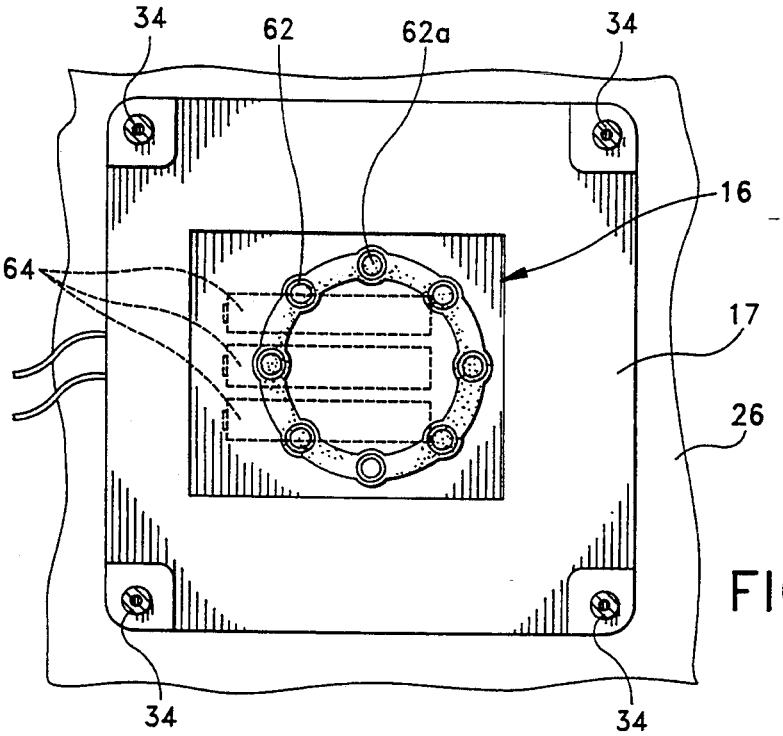
FIG. 3 is a fragmented cross-sectional view of the instant audio playback device taken along line 3—3 in FIG. 1.
Figure 4:
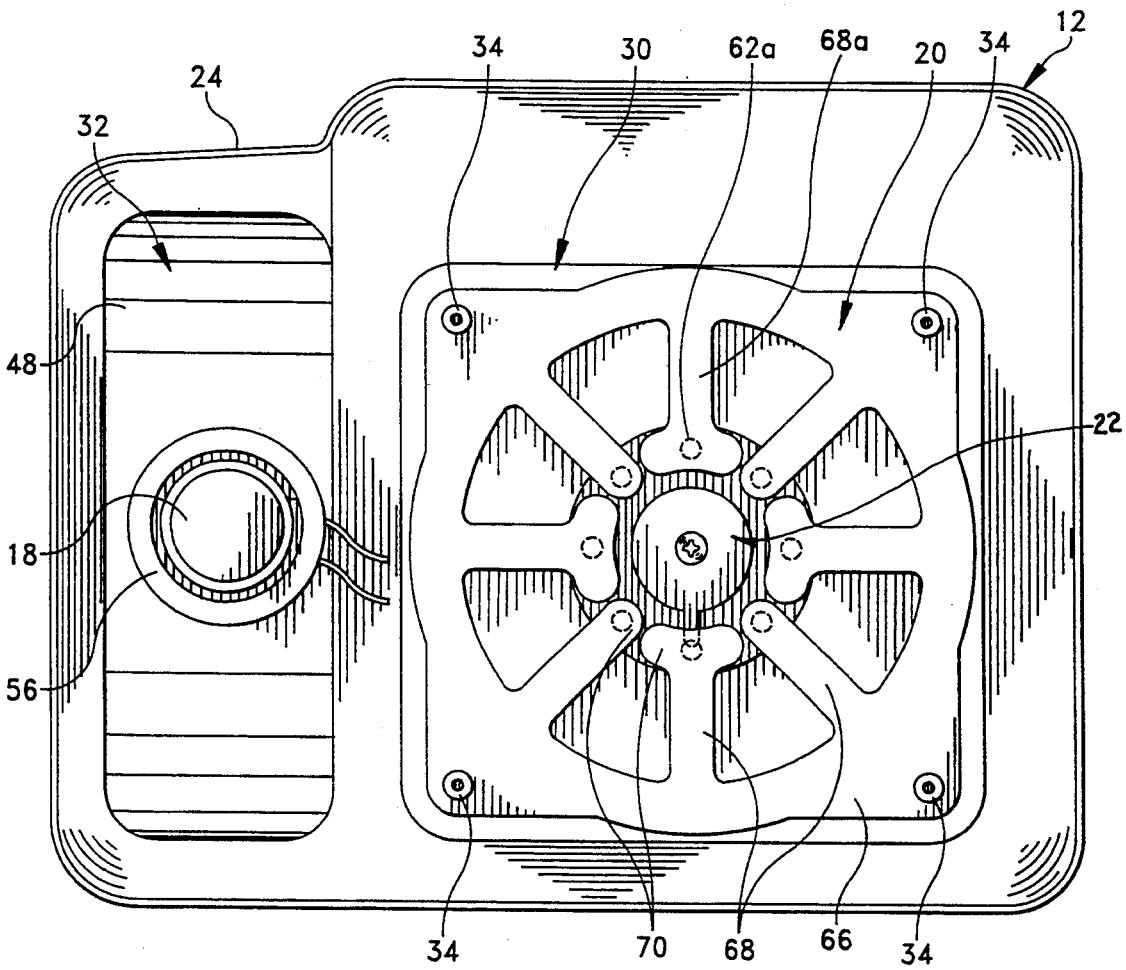
FIG. 4 is another cross-sectional view thereof taken along line 4—4 in FIG. 1.

The lower body section 26 includes a substantially flat base 28 for supporting the housing 12 on a substantially flat supporting surface. The upper body section 24 includes a recessed face plate generally indicated at 30, and a recessed cradle generally indicated at 32. The face plate 30 includes four mounting posts 34 which extend downwardly from a lower surface thereof (FIGS. 3 and 4), and it further includes a plurality of fanciful cartoon images 36, such as a duck **36*a*, on an upper surface thereof (FIG. 1). The mounting posts 34 are operative for supporting the mounting plate 17 and the finger plate 20 below the face plate 30. As herein embodied, the face plate 30 includes eight cartoon images 36 which are arranged in a generally circular array. The face plate 30 still further includes a centrally located aperture 38, and an annular recess generally indicated at 40 which is formed around the central aperture 38. The annular recess 40 includes a bottom wall 42, an outside wall 44, and two circumferentially spaced cam ribs 46 on the outside wall 44. The recessed cradle 32 is formed to resemble the cradle of a conventional telephone, and it is operative for snugly receiving the removable handset element 14 which is formed so as to resemble the handset portion of a conventional telephone. The cradle 32 includes a bottom wall 48 having a plurality of lateral slots 50 formed therein, an upwardly extending side wall 52 and a notch 54 formed in the side wall 52 to facilitate removal of the handset element 14 from the cradle 32. The cradle further includes a circular ridge 56 which extends downwardly from the bottom wall 48. The circular ridge 56 is operable for receiving the speaker 18 in interfitting engagement so that it is positioned directly below the lateral slots 50 which enable the output from the speaker 18** to be heard by the user.

Figure 5:
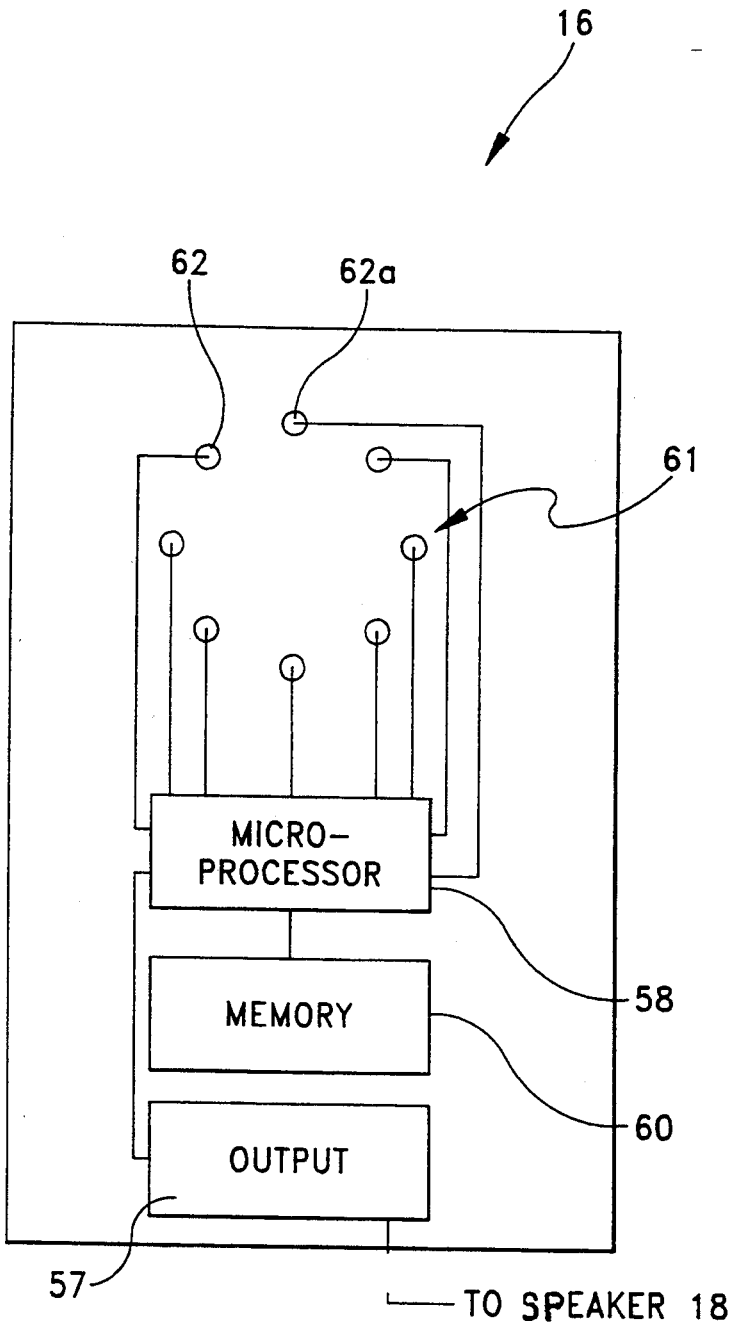
FIG. 5 is a schematic diagram of the audio playback device of the instant invention.

The integrated circuit assembly 16 (FIG. 5) comprises a conventional audio output unit 57 and a microprocessor 58. The circuit assembly 16 further includes a memory 60 which is pre-programmed with a plurality of pre-recorded sound tracks, and a switch assembly 61 comprising a plurality of switches 62 which individually correspond to the pre-recorded sound tracks. The output unit 57 comprises a conventional audio amplification unit. The microprocessor 58 and memory 60 are programmed according to conventional programming techniques and are considered to be conventional in the art. The pre-recorded sound tracks correspond to the eight cartoon images 36 on the face plate 30, such as for example, the sound track corresponding to the duck image **36*a* comprises "The duck goes Quack Quack!" The switches 62** preferably comprise depressible elastomeric switches and they are preferably arranged in a circular array.

The speaker element 18 is conventional in the electronic arts and it is operative for outputting a pre-recorded sound tracks from the output unit 57 when one of the switches 62 is depressed.

The circuit assembly 16 is mounted in the center of the mounting plate 17 which is generally square in configuration. The mounting plate 17 is secured by screws (not shown) to the four mounting posts 34 so that the assembly 61 on the circuit assembly 16 faces upwardly toward the lower surface of the face plate 30, and so that the switches 62 in the switch assembly 61 are in corresponding radial alignment with the images on the face plate 30, i.e. so that the switch **62*a* corresponding to the duck message is radially aligned with the duck image 36*a* on the face plate 30. The mounting plate 17 further includes a conventional battery compartment (not shown) which extends downwardly from the mounting plate 17. The battery compartment is operative for receiving three "AA" size batteries 64, and a removable panel (not shown) is provided in the lower body section half 26 of the housing 12 for inserting the batteries 64 into the battery compartment from the bottom of the housing 12**.

The finger plate 20 is part of the selector mechanism 22 and it is formed from a resilient plastic. The finger plate 20 comprises a generally square frame portion 66, and a plurality of finger portions 68 which extend radially inwardly from the frame portion 66. The finger plate 20 is positioned between the circuit assembly 16 and the face plate 30, so that the frame portion 66 is secured in its four corners to the four mounting posts 34. The finger portions 68 are arranged in corresponding radial alignment with the switches 62, and each finger portion 68 includes a tip portion 70 which is positioned directly above a corresponding switch 62. In this regard, the finger portions 68 are selectively depressible for selectively actuating a corresponding switch 62.

Figure 2:
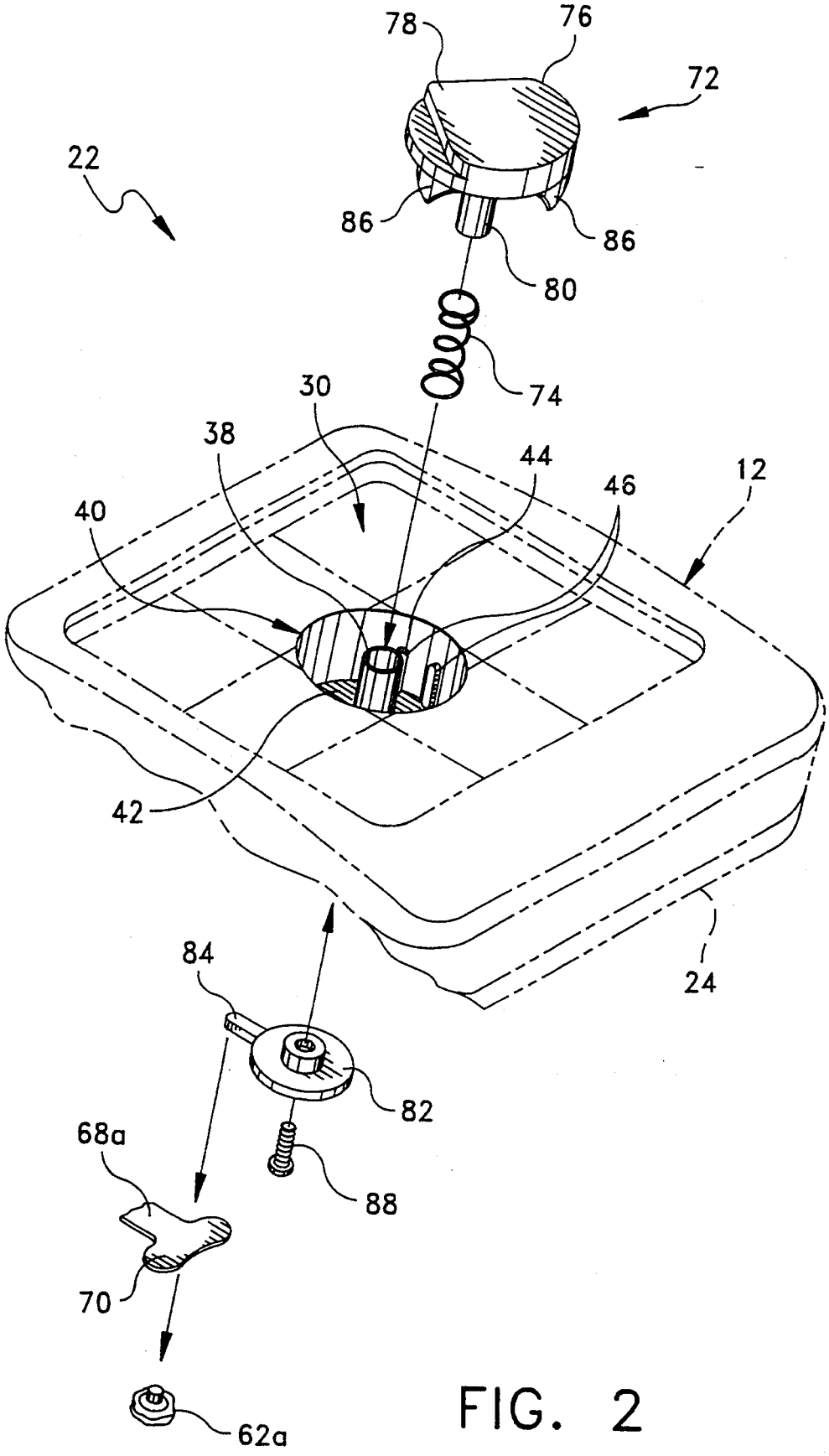
FIG. 2 is an exploded perspective view of the selector mechanism thereof.

The selector mechanism 22 (FIG. 2) further comprises a rotatable dial generally indicated at 72 and a spring element 74. The dial comprises a knob-shaped outer portion 76, a radial indicator arrow 78 on the outer portion 76, a shaft 80 which extends downwardly from the outer portion 76 and through the aperture 38 in the face plate 30, a lower portion 82 which is received beneath the face plate 30, and a radially extending finger 84 on the lower portion 80 which is in radial alignment with the indicator arrow 78. The outer portion 76 of the dial 72 includes four circumferentially spaced, downwardly extending cams 86, and the lower portion 82 of the dial 72 is secured to the shaft 80 by a screw 88. The spring 74 is slidably received around the aperture 38 so that it is positioned between the outer knob portion 76 of the dial 72 and the bottom wall 42 of the annular recess 40. In this regard, the spring 74 is operable for biasing the radial finger 84 upwardly away from the finger plate 20. The dial 72 is rotatable for selecting one of the images 36, such as the duck image 36*a*, on the face plate 30 (as illustrated in FIG. 1). In this regard, the finger 84 on the lower portion 82 of the dial 72 simultaneously rotates into alignment with the corresponding finger portion 68*a* on the finger plate 20, and the finger portion 68*a* is in turn positioned above the switch 62*a* which corresponds to the duck image 36*a*. Once the dial 72 has been rotated into a selected position, it is depressible against the bias of the spring 74, wherein the finger 84 is moved downwardly to depress the finger portion 68*a* aligned therewith which in turn is moved downwardly to actuate the corresponding switch 62*a*. When the switch 62*a* is actuated, the microprocessor 58 operates to output the corresponding pre-recorded sound tracks through the output unit 57 and the speaker element 18 for the operator to hear.

The cams 86 on the outer portion 76 of the dial 72 cooperate with the cam ribs 46 on the outer wall 44 of the annular recess 40 to prevent the dial 72 from being depressed when the dial 72 is not in complete alignment with one of the images 36 on the face plate 30. In this regard, whenever the dial 72 is depressed, the cams 86 and cam ribs 46 cooperate to automatically rotate the dial 72 and finger 84 into one of the predetermined radial positions so that the finger 84 automatically depresses one of the switches 62.

It can therefore be seen that the instant invention provides an amusing audio playback device 10 which has significant play value. The images 36 and switches 62 are arranged in a circular array, and the selector mechanism 22 comprises a dial 72 which is rotatable to select an image 36 and depressible to actuate a switch 62 corresponding to the image 36 so that a microprocessor and an output unit play a corresponding pre-recorded sound track over a speaker 18. The selector mechanism 22 is easy to operate, even for very young children, and it includes a cam mechanism which automatically rotates the dial 72 into a correct position so that it automatically depresses one of the switches 62. For these reasons, the audio playback device of the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An audio playback device comprising:

an image plate having a plurality of images thereon;

sound reproducing means containing a plurality of prerecorded sound tracks, each of said sound tracks corresponding to a respective one of said images;

selector means for individually selecting said images; and switch means actuatable with said selector means for actuating said sound reproducing means to reproduce the prerecorded sound track corresponding to a selected image, said switch means comprising a plurality of depressible switches which are arranged in a circular array, said plurality of images being arranged in a generally circular array wherein said plurality of images are in corresponding radial alignment with said plurality of switches.

2. In the audio playback device of claim 1, said selector means comprising a rotatable selector for individually rotatably selecting said images in said circular array.

3. In the audio playback device of claim 2, said rotatable selector comprising a dial having an outer portion positioned above said image plate, a radial indicator on said outer portion, a shaft extending through an aperture in said image plate, an inner portion positioned below said image plate and adjacent to said plurality of switches, and a radially extending finger on said inner portion which is in radial alignment with said indicator, said dial being rotatable with respect to said image plate wherein said indicator is operable for selecting said images, said dial being depressible wherein said radial finger is operative for selectively actuating the switch corresponding to said selected image.

4. In the audio playback device of claim 3, said selector further comprising spring means for biasing said finger element away from said switches.

5. In the audio playback device of claim 4, said spring means being received between said image plate and said outer portion of said dial.

6. In the audio playback device of claim 3, said image plate having an annular recess formed around said aperture, said annular recess and said outer portion of said dial having cooperating cam means for automatically rotating said dial and said finger into one of a plurality of predetermined radial positions.

7. In the audio playback device of claim 3, said image plate having an annular recess formed around said aperture, said annular recess including two circumferentially spaced cam ribs, said outer portion of said dial including a plurality of downwardly extending, circumferentially spaced cams which cooperate with the cam ribs to automatically rotating said dial and said finger into one of a plurality of predetermined radial positions.

8. The audio playback device of claim 3, said selector further comprising a resilient finger plate positioned between said switches and said image plate, said finger plate having a plurality of radially extending finger portions which are in corresponding radial alignment with said plurality switch, each of said finger portions being selectively depressible so as to selectively operate a corresponding switch, said selector being depressible so as to selectively depress said finger portions.

9. In the device of claim 1, said plurality of depressible switches comprising elastomeric switches.

* * * * *